United States Patent [19]

Lemelson

[11] 4,233,778

[45] Nov. 18, 1980

[54] MODULAR TOY

[76] Inventor: Jerome H. Lemelson, 85 Rector St., Metuchen, N.J. 08840

[21] Appl. No.: 926,135

[22] Filed: Jul. 19, 1978

[51] Int. Cl.[3] ..... A63H 33/26; A63H 33/06; A63H 33/04; G09F 19/00

[52] U.S. Cl. ..... 46/240; 40/426; 46/19; 46/24

[58] Field of Search ..... 317/159; 40/426; 46/24, 46/25, 1 L, 12, 16, 17, 240, 19

[56] References Cited

U.S. PATENT DOCUMENTS

| | | | |
|---|---|---|---|
| 311,793 | 2/1885 | Stranders | 46/19 |
| 1,629,199 | 5/1927 | Bosslet | 46/24 |
| 2,144,835 | 1/1939 | Dickinson | 40/426 |
| 2,814,909 | 12/1957 | Knowles | 46/240 |
| 3,148,477 | 9/1964 | Bjorn et al. | 46/19 |
| 3,496,670 | 2/1970 | Sloop et al. | 46/25 |
| 3,577,672 | 5/1971 | Nutting | 46/19 |
| 3,596,396 | 8/1971 | Thomson | 46/24 |
| 3,614,866 | 10/1971 | Kaneko et al. | 46/25 |
| 3,911,634 | 10/1975 | Horowitz et al. | 46/24 |
| 3,946,520 | 3/1976 | Goldfarb et al. | 46/240 |

*Primary Examiner*—Louis G. Mancene
*Assistant Examiner*—Michael J. Foycik, Jr.

[57] ABSTRACT

A modular toy is provided in the configuration of a building, such as a doll house, formed of a plurality of modular units, each representing, for example, a room or a group of rooms. The modular units are constructed to permit them to be stacked one above the other and/or retained in side-by-side assembly so as to define, when so assembled, a simulated building. In one form, the modular units are molded of plastic with one or more walls thereof shaped to retain objects in place such as furniture, fixtures and appliances. In another form, the modular units are molded in a flat box-like configuration defining five walls of the room which are joined together by molded hinge-like portions permitting the flat molding to be folded into the configuration of the room shell which may also define the walls for the packaging of the unit. In yet another form, the modular units are so assembled and configured that spacing is provided between the ceilings and floors thereof into which spacing a magnet may be manipulated to affect movement of figures and other devices across the floors of the modular units.

5 Claims, 3 Drawing Figures

FIG. 1.
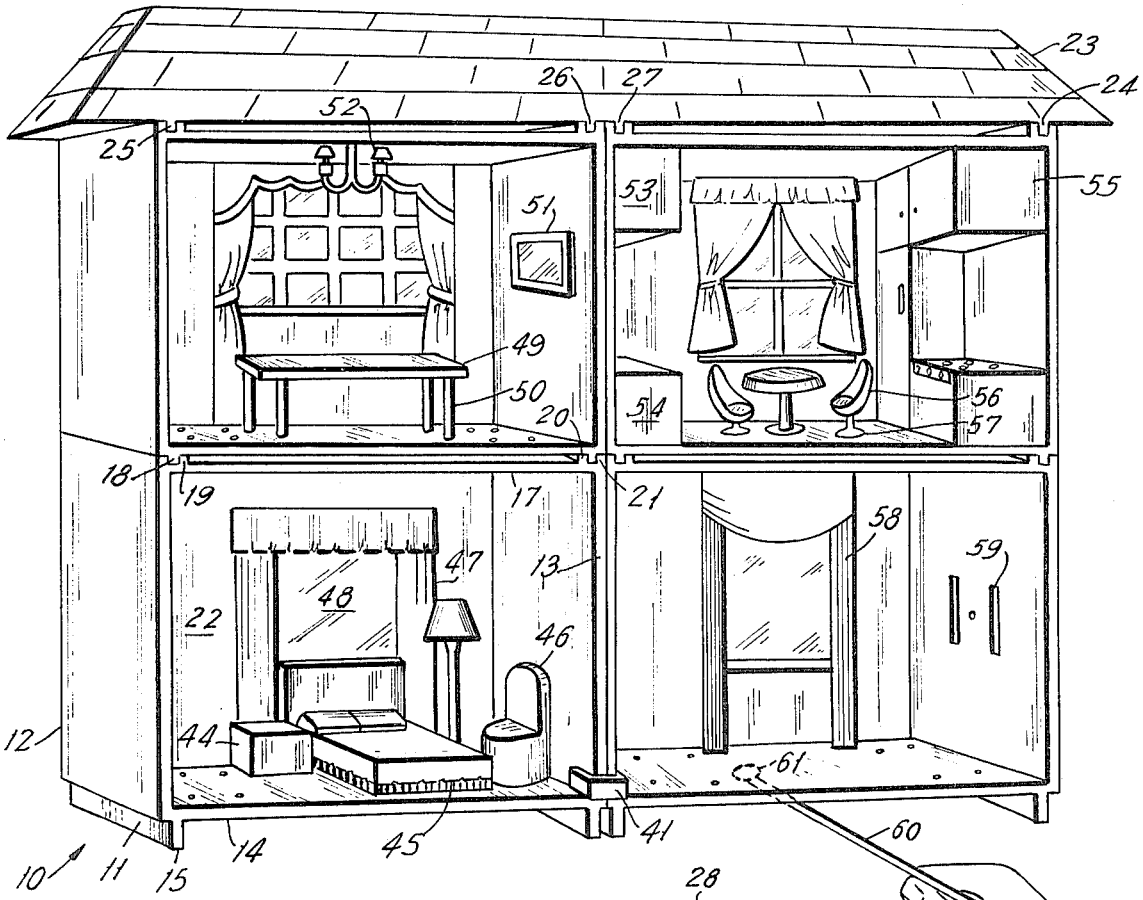
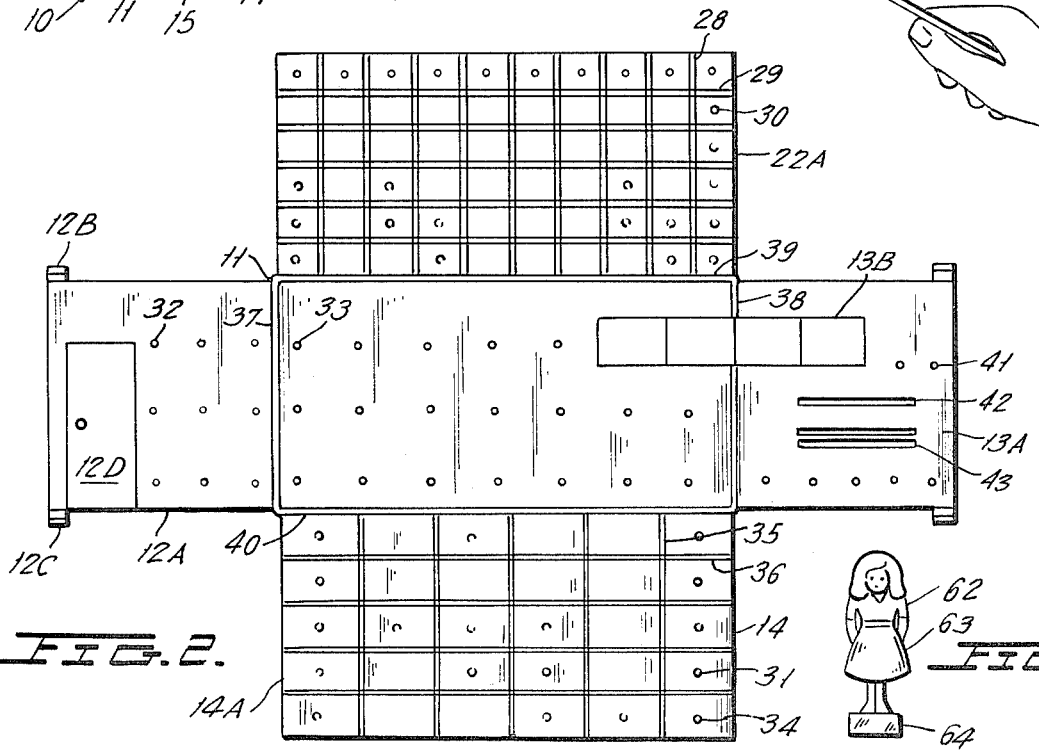
FIG. 2.
FIG. 3.

MODULAR TOY

SUMMARY OF THE INVENTION

This invention relates to modular toys and the like capable of being assembled to form buildings and the like thereof. In particular, the invention is concerned with constructions in simulated room modules which are shaped by molding and which perform a number of functions such as providing the packaging in which the unit and its components may be sold, providing means for removably securing and interchanging simulated components such as furniture, appliances and fixtures to the walls, floor and ceiling of the modules to permit them to be retained in place during packaging and to be interchanged or rearranged and retained in position by children playing with the toy. Novel constructions are also provided to permit such modular units to be easily injection molded of plastic material and to be easily set-up and assembled with their components. The constructions are such that, when the modules are disposed per se on a surface or stacked one above the other, miniature figures and other simulated devices may be moved across the floor portions thereof by magnetism.

Accordingly, it is a primary object of this invention to provide a new and improved assembly toy and a method for assembling and manufacturing same.

Another object is to provide an assembly toy in the form of a multiple room building or house, such as a doll house, which may be formed and sold as separate room units.

Another object is to provide a doll house formed of separate room units or modules which may be easily assembled and disassembled by room.

Another object is to provide an assembly toy in the form of a simulated room containing shaped portions of the walls, floor and ceiling thereof which are configured to frictionally retain room components thereagainst.

Another object is to provide a miniature room module containing room components which may be easily secured to the walls, ceiling and floors thereof wherein the secured components may also be easily removed from their retained positions and secured to other locations or other rooms permitting a variety of combinations and locations to be set up and played with by children.

Another object is to provide a new and improved construction in a container, such as one simulating a room, which is molded in a flat condition and set-up thereafter by pivotting portions of the room or container about molded hinge portions thereof and locking the wall portions together where they meet.

Another object is to provide a modular room simulating toy and one or more figures disposed on the floor thereof together with means for magnetically moving such figures across the floor.

Another object is to provide a simulated animation toy in which movement of components is effected across a surface by means of a hidden magnet which is remotely manipulated adjacent said surface.

With the above and such other objects in view which may hereafter more fully appear, the invention consists of the novel constructions, combinations and arrangements of parts as will be more fully described and illustrated in the accompanying drawings, but it is to be understood that changes, variations and modifications may be resorted to which fall within the scope of the invention as claimed. In the drawings:

FIG. 1 is an isometric view of a doll house which is assembled of a plurality of separate room sections wherein horizontal spacings between the room sections are provided to permit a magnet on the end of a manipulator to be utilized to move objects along the floors of the room sections;

FIG. 2 is a plan view of a flat molding which may be folded and assembled to form a room of a doll house of the type illustrated in FIG. 1, and FIG. 3 is a front view of a simulated doll which may be employed in the doll house of FIGS. 1 and 2.

In FIG. 1 is shown a doll house 10 formed of four separate room sections denoted 10A, 10B, 10C and 10D. Room section 10A forms the lower left portion of the doll house while 10B is disposed immediately above 10A and forms a room on the second floor of the doll house. Section 10C forms the lower right portion of the doll house while 10D forms the room immediately thereabove.

Each of the room sections is preferably formed by molding plastic in the shape of a box or rectangular parallelepiped having five walls with the front wall thereof eliminated to permit the room section to be viewed from the exterior room and to permit simulated furniture, fixtures, appliances and other objects to be adjustably positioned and, in certain instances, attached within the room sections as will be described.

The open box-like shells forming the room sections 10A-10B may be molded in the configuration of an open box as illustrated or may be molded flat as shown in FIG. 2. As molded or when assembled from the flat molding of FIG. 2, each of the room shells contain a floor section 14, a ceiling section 17 and side walls 12 and 13 extending between and joined to the floor and ceiling sections. Protruding downwardly from the floor sections 14 of the lower room shell sections 10A and 10C are a plurality of strip-like formations 11 which are respectively located near the side walls 12 and 13 as shown. These strip-like formations retain the floor sections 14 of the room sections above the surface on which the toy is resting and provide a space therebelow in which a magnet 61 located on the end of a stick or wand 60 may be moved beneath the floors for manipulating an assembly 62 such as a simulated doll figure 63, as illustrated in FIG. 3, which assembly contains a magnet 64 secured to or hidden within its base and polarized so as to be attracted to the magnet 61 located beneath the floor to permit the magnet 61 to move the assembly or figure 62 around the floor in a realistic fashion simulating, for example, the walking movement of the figure.

The upper room sections 10B and 10D are also provided with downwardly protruding strip-like formations 18 and 20 which are supported within the respective channel-like formations 19 and 21 integrally molded in the outer portions of the ceiling section 17 of the room sections immediately therebelow. The strip-like formations 18 and 20 are so dimensioned as to dispose the floors of the upper room sections sufficiently above the ceilings 17 of the lower room sections to permit the wand 60 and magnet thereon to be moved by hand beneath the floors of the upper room sections for manipulating one or more objects or figures thereacross.

A U-shaped clip 41 is shown frictionally engaging and retaining the vertical wall sections of the room sections 10A and 10C to retain lateral assembly of the room sections.

A simulated roof 23 which is preferably also molded of plastic, is assembled with and against the upper walls or ceilings of the room sections 10B and 10D as illustrated, having laterally extending strip-like formations 24, 25, 26 and 27 molded therein and protruding downwardly therefrom to be engaged in respective channels or U-shaped formations integrally molded in the upper walls or ceilings of the room sections 10B and 10D as shown.

In the room section 10A of FIG. 1, assembled against the rear wall 22 thereof is a simulated window 48 and molded plastic drapes 47. Also located within the room section 10A is a simulated molded plastic table 44, a simulated bed 45, chair 46 and lamp. These latter four objects may be frictionally retained in assembly with the floor 14 by means of pin-like protrusions (not shown) extending downwardly from the bottoms of each of these objects and spaced so as to permit them to be frictionally engaged in holes or cavities 30 which are molded in the floor 14. Similar holes or cavities may also be integrally molded in the ceilings, side and rear walls of the room sections 10A–10B for holding fixtures, appliances, simulated electric light fixtures, etc.

Secured to the floor sections of the upper room 10B is a table 49 having a plurality of legs 50, the lower end of which may be shaped to frictionally engage in the holes or cavities molded in the floor section thereof. Notation 51 refers to a simulated picture in a frame which is preferably, although not necessarily removably secured to the inner side wall of the room section, for example, by engagement within vertical slotted openings or formations 59 as illustrated in the lower right hand room section 10C of the house assembly of FIG. 1.

Also shown in the lower right hand room section 10C are drapes and a window, denoted 58, which may be formed as an integral part of the room shell or attached thereto.

In the upper room section 10D is shown a cabinet 53 above a lower cabinet 54 and a second cabinet 55 secured to the opposite side wall above a simulated stove and cabinet assembly. A simulated miniature chair 56 is shown having its base portion 57 cemented or frictionally secured to a molded formation, such as a cavity or hole, formed in the floor of the room section 10D.

In FIG. 2 is shown a flat, sheet-like plastic molding denoted 10E composed of five rectangular sections denoted 12A, 13A, 14A, 17A and 22A wherein the first two rectangular formations 12A and 13A, define the end walls of the room, the second two rectangular formations 14A and 17A define respectively the ceiling and floor of the room and the formation 22A defines the rear wall of the room.

Section 12A is joined to the left hand edge of rear wall section 22A by means of a first molded hinge section 37. Section 13A is joined to the right hand edge of the section 22A by means of a second molded hinge section 38. Ceiling section 17A is joined to the rear wall or central section 22A by means of a third molded hinge section 39 while floor section 14A is joined to the lower portion of the rear wall section 22A by means of a fourth molded hinge section 40. In other words, all five wall sections are integrally molded of the same plastic, such as medium or high density polyethylene or polypropylene which plastics are capable of forming moldings defined by separate portions thereof joined together by hinge-like portions permitting the separate portions to be pivoted with respect to each other without the necessity of securing a separate hinge thereto.

By properly folding and joining the adjacent edges of the rectangular sections 12A, 13A, 14A, 17A and 22A, rectangular parallelepiped room sections or shells of the type illustrated in FIG. 1 may be formed and may also be utilized as the containers for the separate room assemblies particularly if a plastic film is wrapped around or shrunk against the box-shaped room assemblies.

Also shown in FIG. 2 are a plurality of parallel channels 28 and 29 molded integral in the ceiling 17A, a plurality of channels 35 and 36 molded integral in the floor 14A, a plurality of holes or cavities 32 molded in the wall section 12A, a plurality of cavities or holes 30 molded integral in the ceiling section 14A, a plurality of cavities or holes 31 molded integral in the floor section 14A, a plurality of cavities or holes 33 molded integral in the rear wall section 22A and a plurality of cavities or holes 41 molded integral in the side wall section 13A. A plurality of elongated channels denoted 42 and 43 are also illustrated as molded integral in the side wall 13A which may be utilized to hold simulated shelves, pictures or fixtures in frictional assembly therewith.

Notation 12D refers to a simulated door molded integral with the end wall 12A while notation 13B refers to a simulated window or windows molded integral in the end wall 13A and the rear wall 22A. Both the door and windows illustrated may merely be flat representations in relief molded integral with the respective portions of the molding or they may be capable of being pivoted on respective integrally molded poly hinge sections of the molding.

The channel-like formations 28, 29, 35 and 36 which are molded in the ceiling and floor portions 17A and 14A of the molding may be utilized to frictionally retain ceiling fixtures and floor mounted furniture and other devices as may the channels or cavities 30 and 31.

I claim:

1. An assembly toy comprising in combination:

a plurality of containers defining respective room modules and each having side wall portions joined by a bottom wall defining a floor, said modules being assembled in stacked relationship one above the other with the lower of the two stacked modules having a ceiling spaced a distance below the floor of the upper module providing a free space therebetween, a magnet disposed within said free space and a manipulator for said magnet operable from the exterior of the assembly to permit the magnet to be shifted to different locations beneath the floor of the upper module, and a device to be moved across the floor of the upper module including a permanent magnet in the base of said device, said base of said device being disposed on the upper surface of said upper module floor to permit the device to be moved across said floor by the manipulative movement of said magnet within said free space.

2. A toy in accordance with claim 1 including means for removably retaining a plurality of objects in assembly with at least one of the wall portions of one of said containers.

3. A toy in accordance with claim 2 including means for removably retaining a plurality of objects in assembly with the floor portion of one of said containers.

4. A toy in accordance with claim 1 in which said manipulation means comprises an elongated, self-supporting structural member with a permanent magnet secured to the end thereof.

5. A toy in accordance with claim 4 wherein said self-supporting structural member defining said manipulation means is an elongated handle adapted to be hand held and manipulated beneath the floor of said container.

* * * * *